US006789750B1

(12) United States Patent
Heldt

(10) Patent No.: US 6,789,750 B1
(45) Date of Patent: Sep. 14, 2004

(54) FLUID PRODUCT DISPENSER

(75) Inventor: Frédéric Heldt, Louviers (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/979,012

(22) PCT Filed: May 17, 2000

(86) PCT No.: PCT/FR00/01321

§ 371 (c)(1),
(2), (4) Date: Nov. 15, 2001

(87) PCT Pub. No.: WO00/71623

PCT Pub. Date: Nov. 30, 2000

(30) Foreign Application Priority Data

May 21, 1999 (FR) ..... 99 06496

(51) Int. Cl.[7] ..... B05B 1/34

(52) U.S. Cl. ..... 239/490; 239/486; 239/329; 239/333; 239/533.1; 239/602; 128/200.22; 222/386

(58) Field of Search ..... 239/320, 329, 239/333, 486, 490, 491, 533.1, 533.13, 602; 222/326, 327, 386, 387; 128/200.14, 200.22; 604/218, 225

(56) References Cited

U.S. PATENT DOCUMENTS 5,284,132 A * 2/1994 Geier ..... 128/200.22
5,331,954 A * 7/1994 Rex et al. ..... 128/200.22
5,601,077 A * 2/1997 Imbert ..... 128/200.22
5,662,098 A * 9/1997 Yoshida ..... 222/386

* cited by examiner

*Primary Examiner*—Steven J. Ganey
(74) *Attorney, Agent, or Firm*—Sughrue Mion, PLLC

(57) ABSTRACT

A fluid dispenser device comprising a reservoir (10) containing one or more doses of fluid, a dispensing orifice (20), and a dispensing member (30), said device being characterized in that said reservoir is of the syringe type (10) having a hollow tube (11) provided with an upstream opening (12) and with a downstream opening (13), said upstream opening (12) being provided with a piston (40) which, at rest, forms a leaktight stopper, and which co-operates with an actuating rod (30) forming the dispensing member, and said downstream opening (13) being provided with an end-piece (50) firstly incorporating closure means (51) for forming a leaktight stopper at rest, and secondly adapted to define a spray profile (55) when the device is actuated.

17 Claims, 5 Drawing Sheets

FLUID PRODUCT DISPENSER

The present invention relates to a fluid dispenser device, and more particularly to a fluid spray device containing two doses.

Single-dose and two-dose devices are well known in the state of the art, and a two-dose device is disclosed in particular in Document FR-2 761 281.

Since a two-dose device contains very little fluid, the cost of manufacturing the device must naturally be kept as low as possible. However, since the fluid can be a pharmaceutical product, the accuracy with which the doses are metered out and the quality of the dispensing must be good. In addition, simplicity of use is also a very important criterion in devices containing one or two doses. In addition, since the manufacturer of the fluid to be dispensed is often different from the manufacturer of the dispenser device, it is very desirable for the reservoir filling technique and the tools necessary for such filling to be as simple and inexpensive as possible, and to correspond preferably to filling and tools of standard type, well known to fluid manufacturers.

An object of the present invention is to provide a fluid dispenser device, in particular a two-dose device, that procures optimum performance in terms both of dispensing quality and of operating reliability. In particular, the two-dose device of Document FR-2 761 281 has nine component parts. An object of the present invention is to provide a two-dose type dispenser device that is made up of fewer parts.

Another object of the invention is to provide such a fluid dispenser device, in particular a two-dose fluid dispenser, in which the reservoir can be pre-filled and closed off hermetically in leaktight manner, before the device is assembled.

Another object of the invention is to provide a fluid dispenser device, in particular a two-dose device, in which the reservoir is constituted by a standard reservoir, filling of which is well known and therefore simple for the manufacturer of the fluid to be dispensed, without requiring special tools that are complicated and costly.

Another object of the present invention is to provide a fluid dispenser device, in particular a two-dose device, that simultaneously guarantees that the fluid in the reservoir is contained therein in leaktight manner, and also that a dose of fluid is sprayed properly each time the device is actuated.

Another object of the present invention is to provide a fluid dispenser device, in particular a two-dose device, in which it is guaranteed that a dose is dispensed in full each time the device is actuated, and of which any accidental or unwanted actuating is impossible.

The present invention thus provides a fluid dispenser device comprising a reservoir containing one or more doses of fluid, a dispensing orifice, and a dispensing member, said reservoir being of the syringe type having a hollow tube provided with an upstream opening and with a downstream opening, said upstream opening being provided with a piston which, at rest, forms a leaktight stopper, and which co-operates with an actuating rod forming the dispensing member, and said downstream opening being provided with an end-piece firstly incorporating closure means for forming a leaktight stopper at rest, and secondly adapted to define a spray profile when the device is actuated.

Advantageously, said end-piece has a fixing portion for fixing in leaktight manner to said downstream opening of the syringe, a deformable closure portion for acting at rest to close off said downstream opening in leaktight manner, and for being deformed when the device is actuated so as to open said downstream opening, and a spray portion for forming a spray profile while the fluid is being dispensed.

Advantageously, said syringe and said end-piece are inserted into an outer body incorporating the dispensing orifice of the device, said spray portion of the end-piece co-operating with the end wall of said outer body to define the spray profile when the device is actuated.

Advantageously, said end-piece is provided with a central cylindrical stud which, at one end, forms the closure means for closing the downstream opening in the syringe, and, at the other end, forms a plane surface, said stud being moved axially when the device is actuated, so as firstly to open the downstream opening in the syringe, and secondly to press said plane surface against the end wall of the outer body incorporating swirl channels so that said stud defines the spray profile when the device is actuated.

Preferably, said end-piece is made in one piece and of an elastomer material.

Preferably, said actuating rod, which can be moved axially by the user to dispense the fluid, co-operates with an outer body provided with energy storage means for storing up energy in the fingers of the user, thereby guaranteeing that a dose is dispensed in full each time the device is actuated.

Advantageously, said body and said actuating rod co-operate to prevent the device from being actuated accidently.

Preferably, said syringe contains two doses of fluid, and said outer body forms an abutment in the axial stroke of the actuating rod so as to separate said stroke into two stroke portions, each of which corresponds to a respective one of the doses.

Advantageously, after the first dose has been expelled, said actuating rod must be rotated relative to said outer body so that it is possible to expel the second dose.

Advantageously, the outer body has non-return means which co-operate with said rod so as to allow the rod to be rotated in one direction only and to be moved axially in one direction only.

Advantageously, said outer body incorporates a window level with the syringe for viewing the dose to be expelled.

Preferably, said outer body is made in one piece.

Other advantages and characteristics of the present invention appear from the following detailed description of it, given by way of non-limiting example, and with reference to the accompanying drawings, in which.

Figure 1:
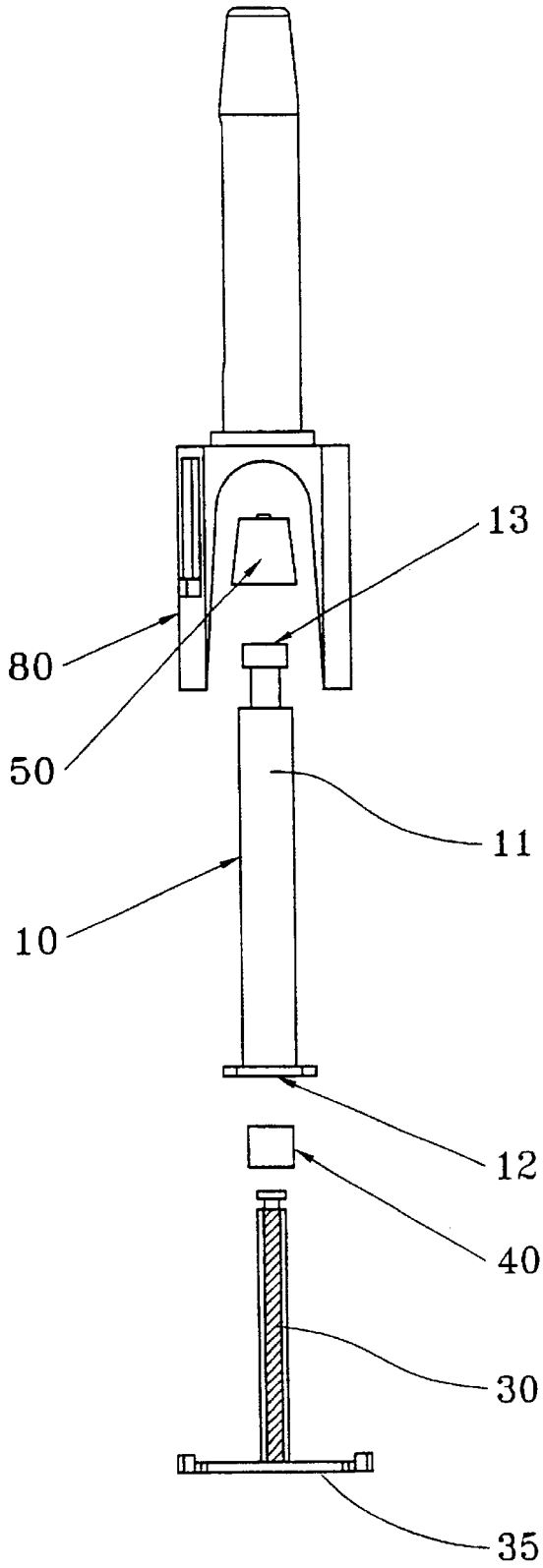
FIG. 1 is an exploded diagrammatic view of the dispenser device of a preferred embodiment of the present invention.

As shown in FIG. 1, the fluid dispenser device of the present invention advantageously comprises five parts only.

These are a reservoir 10, advantageously made in the form of a syringe body having a hollow body 11 provided with an upstream opening 12 and with a downstream opening 13. The upstream opening 13 is closed off in leaktight manner by a stopper 40 adapted to form the dispensing piston when it is actuated via an actuating rod 30, while the downstream opening 13 is closed off in leaktight manner by an end-piece 50. The assembly formed by the syringe 10, the end-piece 50, the stopper piston 40, and the actuating rod 30 is then fixed in an outer body 80.

The outer body 80 is preferably made in one piece, it incorporates the dispensing orifice 20, and it is adapted to co-operate with the actuating rod 30 to guarantee that the device is actuated correctly. Advantageously, the outer body 80 is provided with a window 89 level with the reservoir 10 so that the contents of said reservoir can be viewed from the outside. This characteristic is particularly advantageous when the device is a two-dose device because it is then possible to see whether or not the first dose has been dispensed.

As mentioned above, the reservoir 10 is preferably formed by a syringe body. This considerably facilitates filling of the reservoir, since syringe filling is well known and well mastered by fluid manufacturers. In known manner, the syringe 10 is pre-filled and then its upstream and downstream openings 12 and 13 are closed off respectively by means of a stopper piston 40 and by means of the end-piece 50, so that the unit formed by the reservoir 10 and by the two stoppers 40 and 50 may be pre-filled before the device of the invention is finally assembled. It is thus not necessary for the manufacturer of the fluid to have special tools for assembling a complicated device at the same time as it is being filled, or for filling a device that has already been assembled.

In the invention, the end-piece 50 advantageously procures three functions simultaneously. Firstly, it closes off the downstream opening 13 in the syringe 10 in leaktight manner. Secondly, it provides pre-compression on dispensing. Finally it has means adapted to form a spray profile at the dispensing orifice 20 of the device so that, when the device actuated, the dose of fluid is dispensed in finely sprayed manner. This end-piece is preferably made in one piece and of an elastomer material, and it is shown more precisely in FIGS. 6 to 9. Advantageously, it has a fixing portion 54 for fixing to said opening 13 in the syringe 10, advantageously by snap-fastening. The end-piece 50 also has a deformable closure portion 51 which, at rest, acts as closure means by closing off the syringe in leaktight manner, said closure portion 51 being adapted to deform when the device is actuated, in particular under the effect of the pressure of the fluid, so as to open the downstream opening 13 of the reservoir and so as to enable a dose of fluid to be expelled. Advantageously, said closure means 51 are made in the form of a stud 52 which is inserted in leaktight manner in a small-diameter portion of the outlet of the syringe 10, and which, under the effect of the pressure of the fluid, moves towards a larger-diameter portion of said outlet of the syringe, thereby clearing the passageway for the fluid.

Figure 9:
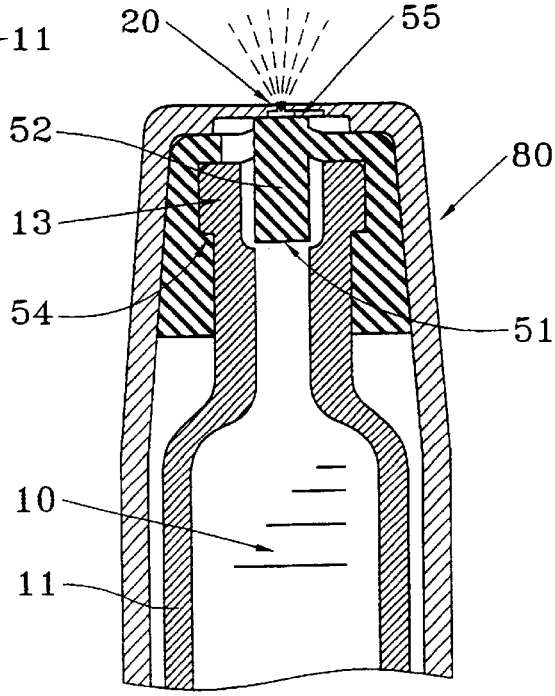

In the invention, the end-piece 50 also advantageously has a spray portion 56 adapted to form a spray profile 55 while the fluid is being dispensed. This spray portion 56 is advantageously made in the form of a plane surface, and, in particular, it can be formed on the opposite side of the stud 52 forming the closure means 51. As can be seen better in FIG. 8, in the rest position, the bottom portion of the stud 52 forming the closure means 51 closes off the syringe 10 while the top portion of the stud forming the spray portion 56 is disposed spaced apart from the end wall 81 of the outer member 80. Preferably, the end wall 81 of the outer member 80 incorporates spray channels or other suitable spray profiles, and when the stud 52 is deformed or moved to open the closure portion 51, as shown in FIG. 9, its plane surface 56 is pressed against said spray profile 81, thereby forming the end wall of this profile and ensuring that the fluid is dispensed in finely sprayed form. In this preferred embodiment, the spray profile 55 is thus formed by the end-piece 50 co-operating with the outer member 80. Naturally, consideration may also be given to providing the spray profile in the end-piece 50, it then being possible for the end wall 81 of the outer member 80 to be plane and to form the end wall of said profile.

Thus, by means of a single part, namely the end-piece 50, the reservoir can be closed off in leaktight manner at rest, the dose of fluid can be sprayed when the device is actuated, and a certain pre-compression that is due to the resistance of the stud 52 to deformation can be obtained in order to open the downstream opening 13 of the syringe 10.

Figure 2:
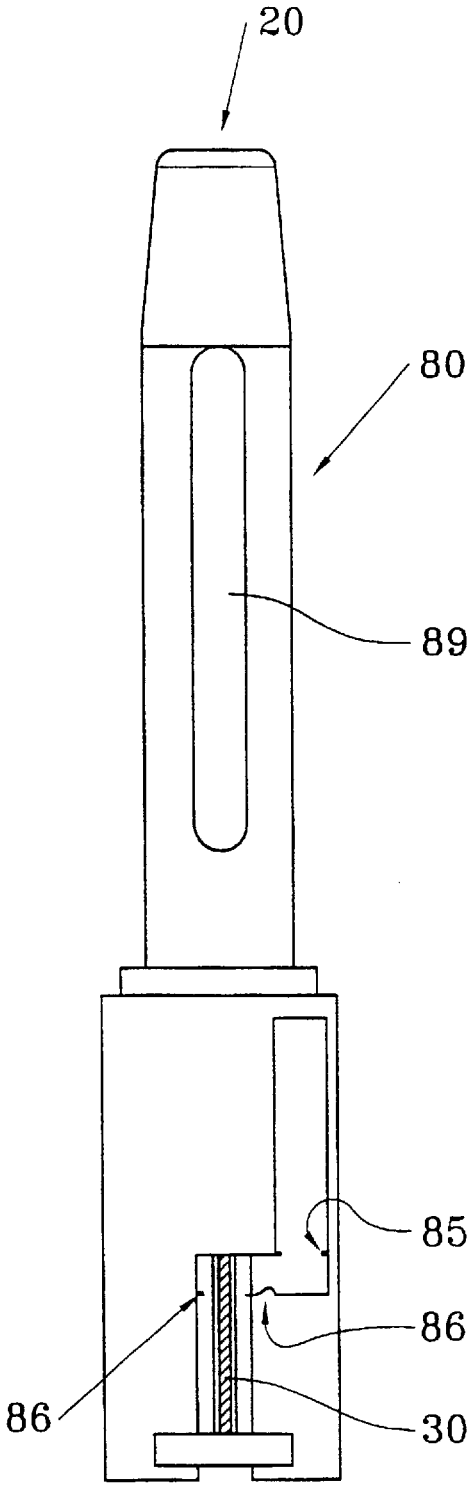
FIG. 2 is a diagrammatic side view showing the dispenser device of the invention in part.
Figure 3:
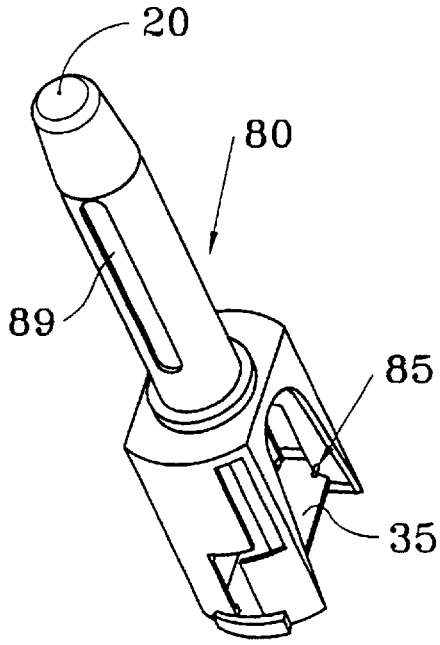
FIG. 3 is a perspective view of the dispenser device of the invention.
Figure 4:
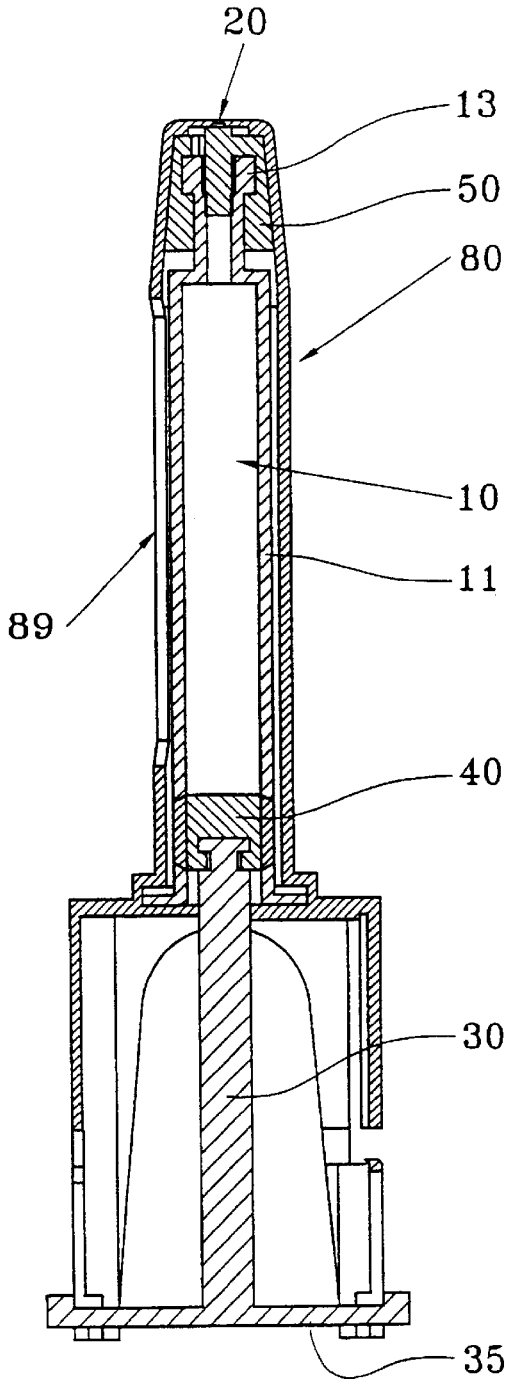
FIGS. 4 and 5 are diagrammatic views in section of the device of the present invention, seen from respective different angles.
Figure 5:
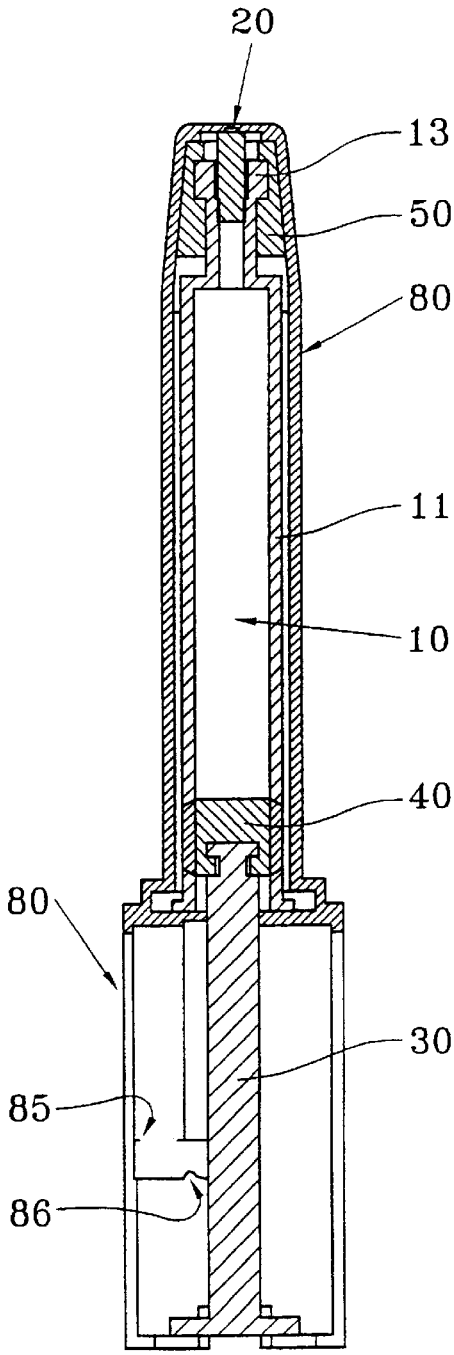
Figure 6:
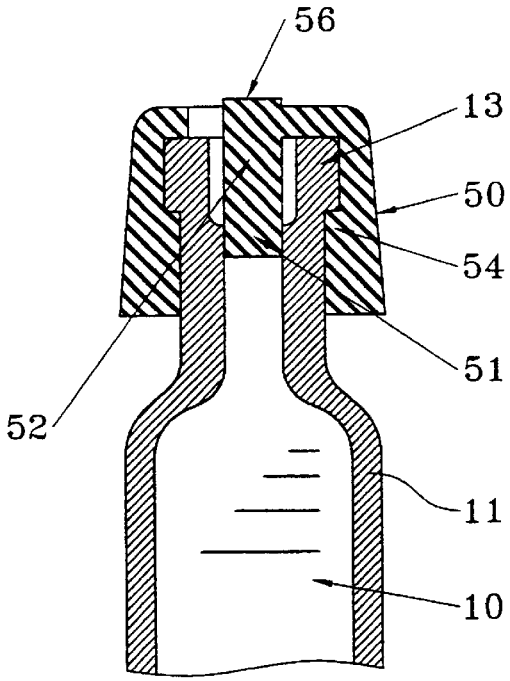
FIG. 6 is a diagrammatic view in section of the top portion of the reservoir incorporating the end-piece, in an embodiment of the present invention, before the dispenser device is assembled in the outer body.
Figure 7:
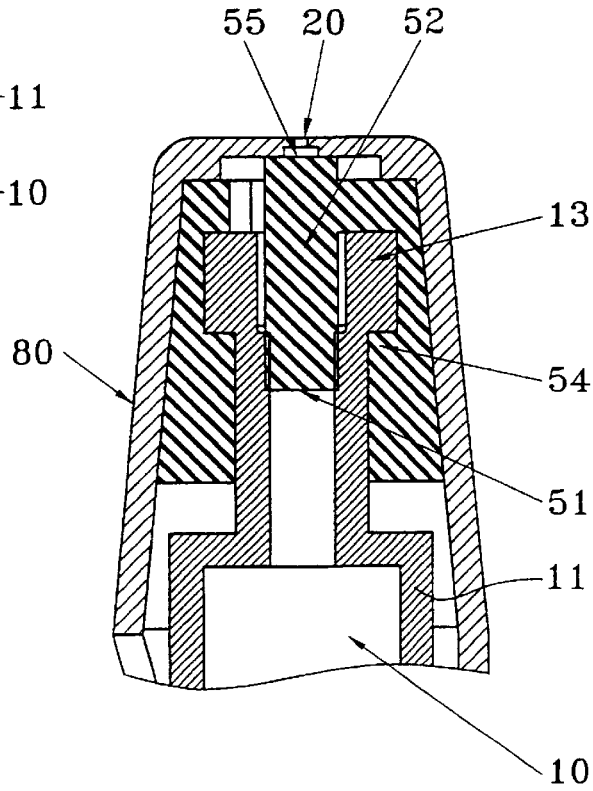
FIG. 7 is a diagrammatic view in section similar to the view of FIG. 6, after the reservoir and the end-piece have been assembled in the outer body.
Figure 8:
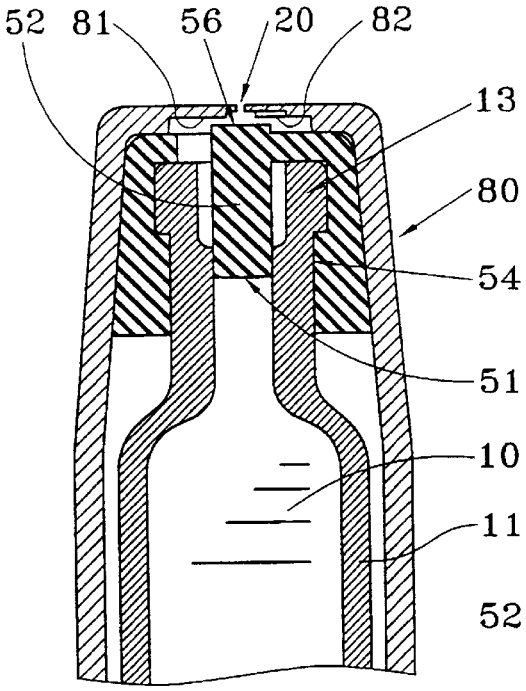
FIGS. 8 and 9 are diagrammatic views in section of the top portion of the fluid dispenser device in a preferred embodiment of the present invention, respectively in the rest position and the expulsion position.

In order to offer an even surer guarantee that each dose is expelled in full, the device includes energy storage means for storing up energy in the hand of the user, which means are preferably formed between the outer body 80 and the actuating rod 30. As shown in the drawings, these energy storage means may be formed by small studs or lugs 85 provided in the inside surface of the outer member 80 and which co-operate with an actuating plate 35 that is secured to the rod 30 and on which the user presses to move said actuating rod 30. A predetermined force is necessary to pass over these lugs, so that the user stores up energy in the fingers until said force is reached, the energy then being released suddenly, guaranteeing that the dose is dispensed in full. These lugs also advantageously act to prevent any undesired actuating of the device. Advantageously, as can be seen, in particular, in FIGS. 2 and 3, the outer member 80 is provided with two grooves, in which the radial ends of said plate 35 extend, thereby preventing the actuating rod form rotating while it is being actuated. When the device is a two-dose device, the outer member 80 is provided with two grooves that are offset over the periphery of the outer member, so that, to expel the second dose, it is necessary to turn the actuating rod 30 so that the actuating plate 35 faces the second groove. Once again, similar energy storage means 85 are advantageously provided to guarantee that the second dose is expelled in full. In addition, the device is also advantageously provided with non-return means that act both on the axial movement of the rod 30, and on the turning thereof. These means are advantageously formed by ramps 86 which allow the actuating plate 35 to go past in one direction, but which prevent it from moving back in the opposite direction. Optionally, it is possible to provide means for preventing the device from being actuated, and making it necessary to turn the actuating rod 30 before it is possible to expel the first dose. In FIGS. 2 and 3, which show a two-dose device, it can be seen that the two offset grooves in the outer body form the abutment which splits the actuating stroke in two so as to dispense the contents of the reservoir in two doses. In particular, after the first dose is dispensed, turning is necessary to enable the second dose to be expelled.

The present invention thus provides a fluid dispenser device (advantageously a two-dose device) that is made up of five parts only, and that procures simultaneously all of the following functions: closing off the outlet of the reservoir at rest and between the two doses; pre-compression during expulsion of each dose; spraying each dose by forming a spray profile during dispensing; storing up energy in the hand of the user before each dose is expelled; safety during transport to prevent it from being actuated accidentally; non-return after the first dose has been expelled so as to prevent the actuating rod from returning to its starting position; forming an autonomous assembly made up of the syringe, of the stopper piston, and of the closure end-piece, enabling said syringe to be filled separately and easily, and procuring a device in which the fluid is in contact with two materials only, namely the material of the syringe (in general, glass) and the material of the two stoppers (in general, an inert elastomer material).

Naturally, the present invention is described with reference to the drawings which show a preferred embodiment of it, but various variants and modifications can be made to the invention without going beyond its ambit, as defined by the accompanying claims. In particular, it is possible to consider providing the device of the present invention with a pre-compressed dispensing system that can be triggered merely by acting on a button or a lever. In which case (not shown), a spring is cocked that is then released by actuating suitable trigger means, the spring then acting on the actuating rod 30 to expel the dose(s). Naturally, other variants are also possible. In addition, the present invention is not limited to two-dose devices, but rather it also applies to single-dose devices, and to devices containing a limited number of doses, e.g. three or four doses.

What is claimed is:

1. A fluid dispenser device compromising a reservoir (10) containing one or more doses of fluid, a dispensing orifice (20), and a dispensing member (30), said reservoir being of the syringe type (10) having a hollow tube (11) provided with an upstream opening (12) and with a downstream opening (13), said upstream opening (12) being prided with a piston (40) which, at rest, forms a leaktight stopper, and which co-operates with an actuating rod (30) forming the dispensing member, and said downstream opening (13) being provided with an end-piece (50) firstly incorporating closure means (51) for forming a leaktight stopper at rest, and secondly adapted to define a spray profile (55) when the deice is actuated, the device being characterized in that said end-piece (50) has a fixing portion (54) fixed in leaktight manner to said downstream opening (13)of the syringe (10) so that the unit formed by the reservoir (10), the piston (40), and the end-piece (50) can be prefilled and closed off in leaktight manner before the device is assembled, said syringe (10) and said end-piece (50) being inserted, during assembly, into an outer body (80) incorporating the dispensing orifice (20) of the device.

2. A device according to claim 1, in which said end-piece (50) bas a deformable closure portion (51) for acting at rest to close off said downstream opening (13) in leaktight manner, and for being deformed when the device is actuated so as to open said downstream opening (13), and a spray portion (56) for forming the spray profile (55) while the fluid is being dispensed.

3. A device according to claim 2, in which said spray portion (56) of the end-piece co-operates with the end wall (81) of said outer body (80) to define the spray profile (55) when the device is actuated.

4. A device according to claim 3, in which said end-piece (50) is provided with a central cylindrical stud (52) which, at one end, forms the closure means (51) for closing downstream opening (13) in the syringe (10), and, at the other end, forms a plane surface (56), said stud (52) being moved axially when the device is actuated, so as firstly to open the downstream opening (13) in the syringe (10), and secondly to press said plane surface (56) against the end wall (81) of the outer body (80) incorporating swirl channels (82) so that said stud (52) defines the spray profile (55) when the device is actuated.

5. A device according to claim 1, in which said end-piece (50) is made in one piece and of an elastomer material.

6. A device according to claim 1, in which said actuating rod (30), which can be moved axially by the user to dispense the fluid, co-operates with an outer body (80) provided with energy storage means (85) for storing up energy in the fingers of the user, thereby guaranteeing that a dose is dispensed in full each time the device is actuated.

7. A device according to claim 6, in which said body (80) and said actuating rod (30) co-operate to prevent the device from being actuated accidentally.

8. A device according to claim 1, in which said syringe (10) contains two doses of fluid, and said outer body (80) forms an abutment in the axial stroke of the actuating rod (30) so as to separate said stroke into two stroke portions, each of which corresponds to a respective one of the doses.

9. A device according to claim 8, in which, after the first dose has been expelled, said actuating rod (30) must be rotated relative to said outer body (80) so that it is possible to expel the second dose.

10. A device according to claim 9, in which the outer body (80) has non-retun means (86) which cooperate with said rod (30) so as to allow the rod (30) to be rotated in one direction only and to be moved axially in one direction only.

11. A device according to claim 8, in which said outer body (80) incorporates a window (89) level with the syringe for viewing the dose to be expelled.

12. A device according to claim 3, in which said outer body (80) is made in one piece.

13. A fluid dispenser device, compromising:

an outer body (80) comprising a dispensing orifice (20);

a reservoir (10) containing one or more doses of fluid; and a dispensing member (30); and wherein the reservoir has a hollow tube (11), comprising:

an upstream opening (12);

a downstream opening (13);

a piston (40) disposed at or near (he upstream opening (12) and which, at rest, forms a leaktight stopper;

an actuating rod (30) that, when actuated, moves the piston within the reservoir; and and end-piece (50) disposed at or near the downstream opening (13), the end-piece comprising a closure member that closes off in a leaktight manner the downstream opening (13) when the actuating rod is at rest, the end-piece cooperating with the outer body to define a spray profile when the actuating rod is actuated; and wherein the end-piece further comprises a fixing portion (54) fixed in leaktight manner to the downstream opening (13) of the reservoir so that the assembly formed by the reservoir (10), the piston (40), and the end-piece (50) are configured to be prefilled and closed off in a leaktight manner before assembling of additional pieces.

14. The fluid dispenser device according to claim 13, wherein the reservoir and the end-piece (50) are inserted into the outer body (80).

15. The fluid dispenser device according to claim 13, wherein the end-piece (50) is made in one piece and of an elastomer material.

16. The fluid dispenser device according to claim 13, wherein the actuating rod (30), which is axially movable when actuated to dispense the fluid, co-operates with the outer body (80) provided with energy storage means (85) for storing up energy in the fingers of the user, thereby guaranteeing that a dose is dispensed in full each time the device is actuated.

17. The fluid dispenser device according to claim 13, wherein the reservoir contains two doses of fluid, and the outer body (80) forms an abutment in an axial stroke of the actuating rod (30) so as to separate the stroke into two stroke portions, each of which corresponds to a respective one of the doses.

* * * * *